US009616443B2

(12) United States Patent
Kylling et al.

(10) Patent No.: US 9,616,443 B2
(45) Date of Patent: Apr. 11, 2017

(54) ON-DEMAND OPERATION OF A FLEXOGRAPHIC COATING UNIT

(71) Applicant: Tresu A/S, Bjert (DK)

(72) Inventors: Mads Kylling, Haderslev (DK); Marko Ryynänen, Pulp (FI); Erik Gydesen, Bjert (DK); Petri Sirviö, Imatra (FI)

(73) Assignee: Tresu A/S, Bjert (DK)

( * ) Notice: Subject to any disclaimer, the term of this patent is extended or adjusted under 35 U.S.C. 154(b) by 120 days.

(21) Appl. No.: 14/396,933

(22) PCT Filed: Apr. 23, 2013

(86) PCT No.: PCT/EP2013/058369

§ 371 (c)(1),
(2) Date: Oct. 24, 2014

(87) PCT Pub. No.: WO2013/160289

PCT Pub. Date: Oct. 31, 2013

(65) Prior Publication Data

US 2016/0001311 A1 Jan. 7, 2016

(30) Foreign Application Priority Data

Apr. 24, 2012 (FI) ..... 20125447

(51) Int. Cl.

| | |
|---|---|
| ***B05C 1/02*** | (2006.01) |
| ***B05C 13/02*** | (2006.01) |
| ***B05D 1/28*** | (2006.01) |
| ***B41F 19/00*** | (2006.01) |
| ***B41F 33/00*** | (2006.01) |
| ***B41F 35/00*** | (2006.01) |
| ***B05B 9/03*** | (2006.01) |
| ***B05C 13/00*** | (2006.01) |
| ***B41F 35/04*** | (2006.01) |
| ***B41F 21/00*** | (2006.01) |
| ***B41F 33/06*** | (2006.01) |
| ***B41F 33/12*** | (2006.01) |
| ***B41F 33/08*** | (2006.01) |
| ***B41F 33/16*** | (2006.01) |
| ***B41F 35/02*** | (2006.01) |
| ***B41F 23/08*** | (2006.01) |
| ***B05D 1/00*** | (2006.01) |
| ***B41F 23/00*** | (2006.01) |

(52) U.S. Cl.

CPC ..... *B05B 9/03* (2013.01); *B05C 1/025* (2013.01); *B05C 1/027* (2013.01); *B05C 13/00* (2013.01); *B05C 13/02* (2013.01); *B05D 1/005* (2013.01); *B05D 1/28* (2013.01); *B41F 19/001* (2013.01); *B41F 19/002* (2013.01); *B41F 21/00* (2013.01); *B41F 23/00* (2013.01); *B41F 23/08* (2013.01); *B41F 33/00* (2013.01); *B41F 33/06* (2013.01); *B41F 33/08* (2013.01); *B41F 33/12* (2013.01); *B41F 33/16* (2013.01); *B41F 35/00* (2013.01); *B41F 35/02* (2013.01); *B41F 35/04* (2013.01); *B05D 2203/22* (2013.01); *B05D 2252/04* (2013.01); *B41P 2235/242* (2013.01); *B41P 2235/244* (2013.01); *B41P 2235/246* (2013.01); *B41P 2235/26* (2013.01)

(58) Field of Classification Search

CPC ..... B05C 1/025; B05C 1/027; B05C 13/00; B05C 13/02; B05D 1/28; B05D 2203/22; B05D 2252/04; B41F 19/001; B41F 19/002; B41F 21/00; B41F 33/00; B41F 33/06; B41F 33/08; B41F 33/12; B41F 35/00; B41F 35/02; B41F 35/04

USPC ..... 118/205, 231, 241, 245, 247, 255, 264, 118/266, 210, 211, 219, 226, 230, 232, 118/233, 237, 239, 243, 257, 263, 238, 118/500, 503; 134/51; 156/345.23, 384, 156/387; 216/83; 184/100; 427/114, 427/211, 428.01, 429, 499, 439, 396, 395, 427/394, 391, 326, 288, 285, 121; 101/480, 32, 231, 232, 239, 241, 242, 101/484, 233, 234, 416.1, 423, 424, 425; 226/10; 15/256.51, 256.52, 256.53; 228/22, 23

See application file for complete search history.

(56) References Cited

U.S. PATENT DOCUMENTS 2,406,006 A * 8/1946 Eckhard ..... B41F 21/08 101/242
2,831,425 A * 4/1958 Hans-Bernhard ..... B41F 21/05 101/232

(Continued)

FOREIGN PATENT DOCUMENTS

CN 1141237 A 1/1997
CN 1449330 A 10/2003

(Continued)

OTHER PUBLICATIONS

English-language machine translation of DE 195 23 879, generated Oct. 16, 2016, 4 pages.*

*Primary Examiner* — William Phillip Fletcher, III
(74) *Attorney, Agent, or Firm* — David S. Safran

(57) ABSTRACT

A coating unit is located after a sheet-fed digital printer on a manufacturing line. As a response to a workpiece entering the coating unit from the printer, coating substance is dosed onto a plate cylinder, and said plate cylinder is rotated to transfer said coating substance onto the workpiece, which is then transferred further on the manufacturing line. As a response to a first time limit expiring after transferring the workpiece further without a subsequent workpiece entering the coating unit, the rotation of the plate cylinder is stopped.

15 Claims, 4 Drawing Sheets

(56) References Cited

U.S. PATENT DOCUMENTS

| | | | | |
|---|---|---|---|---|
| 2,894,481 | A * | 7/1959 | Stuchbery | B05C 1/025 101/233 |
| 3,822,644 | A * | 7/1974 | Gazzola | B41F 13/12 101/242 |
| 4,953,463 | A * | 9/1990 | Hara | B41F 35/006 101/425 |
| 8,210,102 | B2 | 7/2012 | Hirata | |
| 8,251,498 | B2 | 8/2012 | Shimizu et al. | |
| 2004/0040460 | A1 | 3/2004 | Frei et al. | |
| 2010/0220160 | A1* | 9/2010 | Shimizu | B41J 11/0015 347/85 |

FOREIGN PATENT DOCUMENTS

| | | | |
|---|---|---|---|
| DE | 195 23 879 | A1 * | 1/1997 |
| DE | 102004002521 | A1 | 8/2005 |
| DE | 10 2004 062 114 | A1 | 7/2006 |
| DE | 10 2008 020 393 | A1 | 10/2009 |
| DE | 20 2010 007 499 | U1 | 10/2010 |
| GB | 2 010 741 | A | 7/1979 |
| JP | 2004-181899 | A | 7/2004 |

* cited by examiner

ON-DEMAND OPERATION OF A FLEXOGRAPHIC COATING UNIT

BACKGROUND OF THE INVENTION

Field of the Invention

The invention concerns in general the technology of coating units that are used as integrated parts of a manufacturing line. Especially, the invention concerns the optimized operation of a coating unit that follows a sheet-fed digital printer.

Description of Related Art

Many manufacturing processes involve handling workpieces initially in planar, sheet-like form. As an example, the manufacturing process of packages is considered. The manufacturing process is typically arranged so that it takes advantage of the relatively easy handling of workpieces at the stage when they are still in planar form. A typical process for manufacturing cardboard packages comprises at least a printer, a stacker, and a die cutter in this order. Coaters, dryers, and/or other arrangements may follow the printer for implementing steps that from the viewpoint of printing represent post-processing. As an example, a coater may be disposed directly after the printer and used to apply a layer of water- or solvent-based varnish over at least parts of the printed surface.

At the time of writing this description, the printer is more and more often a sheet-fed digital printer, capable of flexibly producing short series and making fast changes to at least parts of the printed pattern(s) even after each work-piece. Compared to the relatively long and regular runs made with traditional web-fed printing presses, print works executed with a sheet-fed digital printer are frequently characterized by irregular output, meaning that pauses of variable duration may occur between consecutive workpieces and series of workpieces that come out of the printer. A consequence of the flexibility of the printer is a requirement for also the subsequent machinery to adapt their operation to the irregularities in operation.

As an example, consider a flexographic coating unit like the one schematically illustrated in FIG. 1. Printed sheets come from the left in the drawing, pass between a plate cylinder 101 and an impression cylinder 102, and continue to the right in the drawing to be stacked and/or transported further to die-cutting. An inking arrangement, shown schematically to comprise a fountain roller 103 and an anilox roller 104 in FIG. 1, is used to dose varnish or some other coating substance onto the surface of the plate cylinder 101. Some kind of transport arrangement is needed in order to keep the workpieces moving, because unlike the material web in web-fed processes, the sequence of separate sheet-like workpieces cannot be drawn from ends. In FIG. 1, vacuum belts 105 have been illustrated as an example of a transport arrangement.

If the coating substance is to be applied in specific patterns, the mirror images of corresponding patterns have been formed in positive (as elevated areas) on the surface of the plate cylinder. The coating substance then only becomes spread on the elevated areas, and consequently forms the desired patterns on the printed surface when the surface of the plate cylinder presses against the appropriate workpiece. The "printing plate", as the outmost surface layer of the plate cylinder is called, is made of flexible material such as a selectively hard-ened light-sensitive polymer, which explains the descriptor "flexographic".

A particular disadvantage of prior art coating units was their tendency of becoming contaminated or even clogged with leftover coating substance. Not only the outer surface of the plate cylinder, but also parts of the machinery where no coating substance should appear in the first place, slowly but certainly accumulate contamination that originates, e.g., from unintended splashes and small amounts of coating substance spreading around in aerosol form. This disadvantage becomes more prominent with water-based varnish than with UV-hardened coating substances.

Prior art is known from Japanese Patent Application JP2004181899A which discloses a coater printing plate varnish drying prevention device, U.S. Pat. No. 2,894,481 which discloses control devices for apparatus for applying coatings to metal sheets, German Patent Application DE19523879A1 which discloses a sheet conveying system in a digital printing press and from U.S. Pat. No. 8,251,498 B2 which discloses a processing liquid applying apparatus and image-forming apparatus.

SUMMARY OF THE INVENTION

An objective of the present invention is to enhance the operability of a manufacturing line where a coating unit follows a sheet-fed digital printer. Another objective of the invention is to optimize the use of coating substance in such a coating unit. Yet another objective of the present invention is to decrease the need for cleaning of a coating unit.

These and further advantages can be achieved by rotating the plate cylinder of a coating unit only according to need and following a particular timing schedule, and not automatically continuously.

The exemplary embodiments of the invention presented in this patent application are not to be interpreted to pose limitations to the applicability of the invention. The verb "to comprise" is used in this patent application as an open limitation that does not exclude the existence of features that have not been described. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
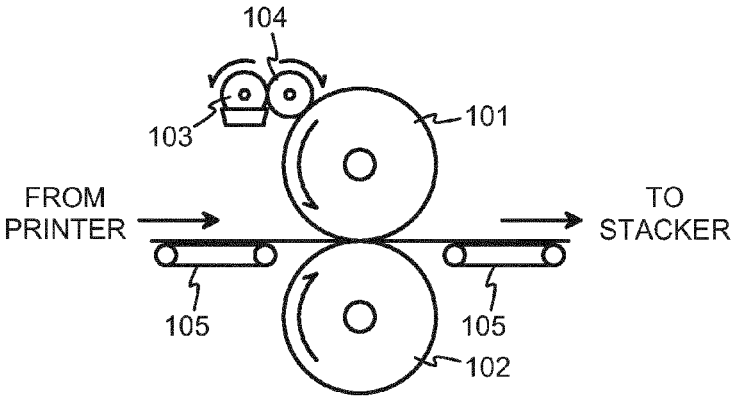
FIG. 1 PRIOR ART
FIG. 1 illustrates a prior art coater.
Figure 2:
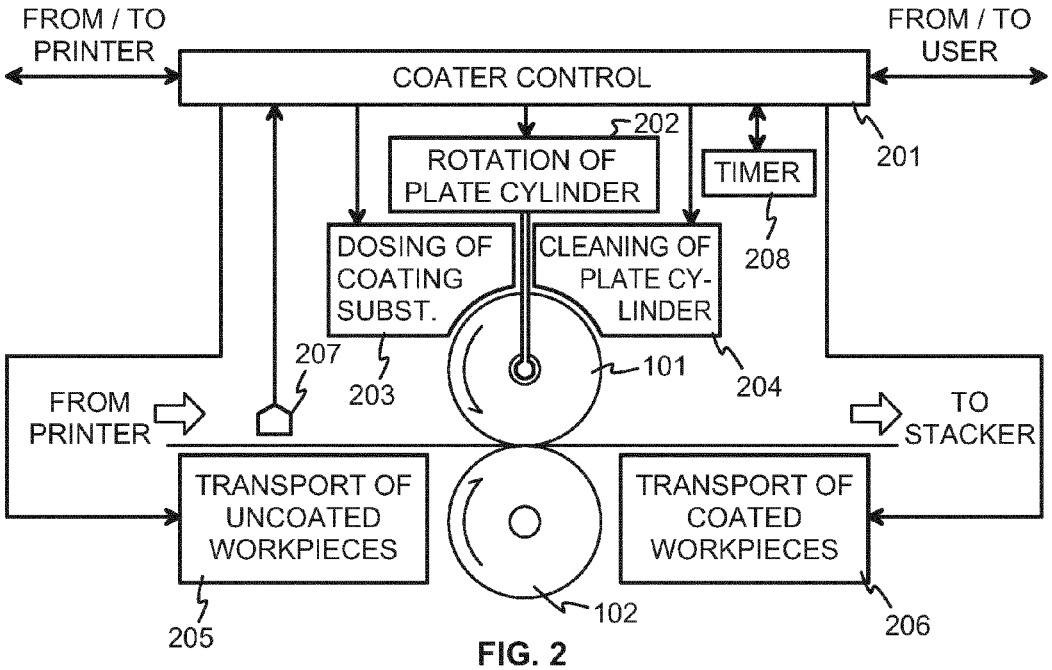
FIG. 2 illustrates aspects of controlling a coater.

In FIG. 2, a coater controller 201 is shown. Its task is to control the actions that the coater takes both in order to apply coating substance to planar, sheet-fed workpieces and in order to automatically perform maintenance functions that ensure smooth operation of the coater on a manufacturing line where a sheet-fed digital printer precedes the coater.

A plate cylinder control entity 202 is responsible for rotating the plate cylinder 101 in accordance with control commands given by the coater controller 201. The plate cylinder control entity 202 may also include sensors (not separately shown) that provide the coater controller 201 with feedback of features such as a rotational speed and/or momentary rotational position of the plate cylinder. Feedback is not obligatory, for example, if an open-loop control system with a stepper motor is used as a part of the plate cylinder control entity 202 to rotate the plate cylinder 101.

A coating substance dosing entity 203 is responsible for dosing varnish or other coating substance onto appropriate areas of the outer surface of the plate cylinder 101. The coating substance dosing entity 203 may be completely mechanical, for example, so that a rotating movement of the plate cylinder 101 is conveyed mechanically to the coating substance dosing entity 203 where it rotates one or more rollers that transfer coating substance from a reservoir to the outer surface of the plate cylinder 101. It is also possible to use a servo-controlled dosing entity where movements of the moving parts, including rotational and translational movements, can be separately controlled in various directions. A separately controllable coating substance dosing entity is particularly advantageous if the dosing of the coating entity needs to be controlled independently of the rotating movement of the plate cylinder 101.

A plate cylinder cleaning entity 204 is responsible for cleaning the outer surface of the plate cylinder 101 according to need and according to commands received from the coater controller 201. An advantageous embodiment of a plate cylinder cleaning entity is described in more detail later.

Two transport arrangements, one 205 for uncoated workpieces that enter the coater from the printer preceding it and another 206 for coated workpieces that are transferred further on the manufacturing line, are shown in FIG. 2. The transporting of workpieces could also be considered as a whole. As an example, vacuum belts with controllable electric motors can be used to implement the transport arrangements 205 and 206, so that control signals for the motors come from the coater controller 201. An advantage of vacuum belts is their ability to move planar, sheet-fed workpieces forward on the manufacturing line by only touching their one (lower) surface. Printing and coating are typically made on the other (upper) surface with substances that need a certain time to dry, so it is advantageous to be able to move the workpieces forward without touching their upper surfaces.

A sensor 207 is provided for providing the coater controller 201 with indications about workpieces when they enter the coating unit on the manufacturing line. The distance between the sensor 207 and the nip between the plate cylinder 101 and impression cylinder 102 may be, for example, a couple of decimeters. It is advantageous to have also a data connection between a printer controller (not shown in FIG. 2) and the coater controller 201, so that the coater controller may receive an advance warning when workpieces are about to appear. Nevertheless, using a sensor 207 at a fixed distance ahead of the nip gives valuable additional information about the accurate timing of an incoming workpiece.

As a part of the coater controller 201, or at its disposal, a timer 208 is provided. The timer 208 is used to monitor the time intervals that take place between various operations of the coater, and also to give triggering inputs to the coater controller 201 when certain time limits expire.

Figure 3:
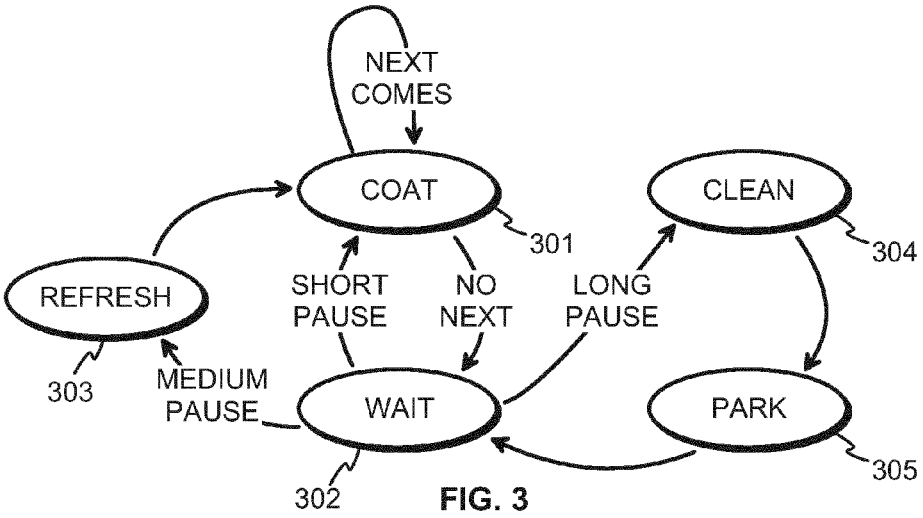
FIG. 3 illustrates a method according to an embodiment of the invention.

FIG. 3 illustrates a method according to an embodiment of the invention in the form of a simplified state diagram of a coating unit. Operation that corresponds to state 301 is initiated as a response to a workpiece entering the coating unit from a sheet-fed digital printer, after which the coating unit is located on a manufacturing line. State 301 corresponds to coating a workpiece, i.e., dosing coating substance on a plate cylinder, rotating the plate cylinder to transfer said coating substance onto said workpiece, and transferring said workpiece further on the manufacturing line. If a subsequent workpiece enters the coating unit directly thereafter, there is no transition to another state, but just a loop into the state 301 occurs, as illustrated by the curved arrow in the top part of FIG. 3.

As a response to a first time limit expiring, after transferring the previous workpiece further, without a subsequent workpiece entering the coating unit, a state transition occurs to the wait state 302, which comprises stopping the rotation of the plate cylinder. In other words, the plate cylinder is stopped rotating if there is no immediate need to coat another incoming workpiece.

When a transition occurs from the wait state 302 to another state, depends on how long it takes for the subsequent workpiece to enter the coating unit. If the subsequent workpiece enters the coating unit before a second time limit expires, an immediate transition (represented by the "short pause" arrow) to state 301 takes place, and coating action described above is directly repeated. If the subsequent workpiece enters the coating unit after said second time limit expired, but before a third time limit expires, a transition to state 303 occurs according to the "medium pause" arrow. State 303 comprises rotating the plate cylinder through a refreshing round of dosing coating substance before commencing the coating action of the subsequent workpiece.

The role of the refreshing round at state 303 may be briefly considered. During the waiting period, the coating substance that was left on the surface of the plate cylinder is drying all the time. After the waiting period has lasted longer than the second time limit mentioned above, the layer of coating substance on the surface of the plate cylinder has become so dry that trying to transfer it onto the next workpiece could result in suboptimal quality of the coating. Therefore, it is advantageous that information about the next workpiece entering the coating unit triggers a transition to the refresh state 303, in which some fresh coating agent is dosed on the surface of the plate cylinder before the coating of the next workpiece can begin.

If the waiting period becomes still longer, as a response to a third time limit expiring without the subsequent workpiece entering the coating unit, there occurs a transition from state 302 to a cleaning state 304 which comprises cleaning the outer surface of the plate cylinder. As the remaining coating agent was still drying on the surface of the stationary plate cylinder, after the third time limit, it is so dry that it would not only cause suboptimal coating quality at an attempted transfer onto a workpiece, but it would even resist the renewing effect of a refreshing round. Therefore, it is better to wash it away and begin the coating of the subsequent workpiece, once it enters the coating unit, with a completely new layer of coating substance on the plate cylinder surface.

After the cleaning has been performed at state 304, a transition occurs to state 305, which comprises parking the plate cylinder in a waiting position. When the plate cylinder has been parked, a transition to the wait 302 state takes place. Since the outer surface of the plate cylinder is now clean, the next transition from the wait state 302 should be always through state 303 to state 301 irrespective of the length of the remaining waiting period.

Figure 4:
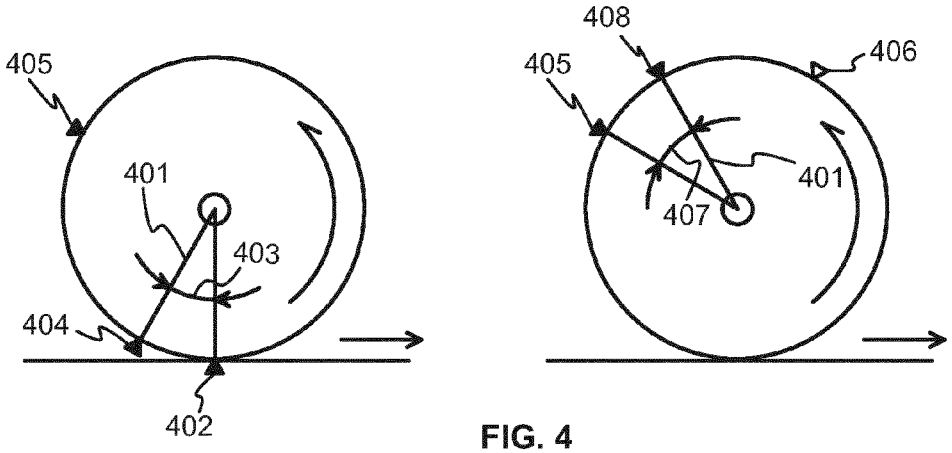
FIG. 4 illustrates aspects of rotational positions of a plate cylinder.

FIG. 4 illustrates certain aspects of the rotational positions of the plate cylinder. The radial line 401 illustrates the location of the front edge of the printing plate, i.e., the position on the outer surface of the plate cylinder that should align with the front edge of a planar, sheet-fed workpiece for the coating to align appropriately. The nip, where the transfer of coating substance to the workpiece takes place, is at point 402.

Above it was described how the plate cylinder may be stationary after the first time limit has expired, but the coating of a subsequent workpiece may begin directly (i.e., without any refreshing round) if the subsequent workpiece enters the coating unit before the expiry of the second time limit. Knowing the exact distance from the sensor 207 (see, FIG. 2) to the nip at point 402, and the velocity at which the transport arrangement 205 (see, FIG. 2) moves the uncoated workpieces, the time can be calculated during which the plate cylinder must be accelerated to again rotate at full coating speed. Knowing the rotational acceleration that the plate cylinder control entity 202 (see, FIG. 2) is capable of producing, there can be calculated the angle 403 by which the plate cylinder rotates during acceleration. Thus, the appropriate rotational position, in which the plate cylinder should be stopped to wait between the expiration of the first and second time limits, is at point 404.

Point 405 is the point where the dosing of coating substance onto the surface of the plate cylinder takes place. If the point 404, at which the front edge of the printing plate is located when the plate cylinder is stationary, would be on the other side of point 405 (i.e., so that in the rotating direction, after passing point 402, point 404 would come before point 405), there might be no need for a refreshing round even after the expiration of the second time limit: starting the rotation of the plate cylinder when the subsequent workpiece arrives would automatically take the whole printing plate through point 405 for receiving fresh coating substance. However, firstly, the plate cylinder control entity 202 may be powerful enough to accelerate the plate cylinder to full coating speed in just a small fraction of the complete round, which brings point 404 relatively close to the nip at point 402. Secondly, the coating substance dosing entity 203 may be such that ensuring the uniform dosing of an even layer of coating substance onto the plate cylinder requires a certain minimum rotating speed. Thus even if the point 404 was on the other side of point 405, a complete accelerating round could be needed before the dosing of a new layer of coating substance could begin.

In the right-hand part of FIG. 4, point 406 is the point at which cleaning of the outer surface of the plate cylinder takes place. Knowing the rotational acceleration that the plate cylinder control entity 202 (see FIG. 2) is capable of producing, and the minimum rotational speed that the plate cylinder must have for the dosing of the coating substance to operate appropriately, there can be calculated the angle 407 by which the plate cylinder rotates during acceleration from full stop to said minimum rotational speed. Consequently, at the park state 305 (see, FIG. 3) after cleaning, the plate cylinder should be stopped to wait for the next workpiece to enter the coating unit at point 408.

The optimal length of the time limits that have been described above depend on many factors, such as the coating substance used (especially the rate at which it solidifies), the material of the printing plate, the environmental conditions (especially temperature and moisture content in air), the printing speed (i.e., the speed at which workpieces move through the coater), as well as the time it takes for the plate cylinder to accelerate to full coating speed. In an exemplary case, in which printing speed is between 1 and 1.25 meters per second, the ends included, and water-based varnish is used as the coating substance, the first time limit (after which the plate cylinder is stopped) is less than one second; the second time limit (after which re-starting the plate cylinder goes through a refreshing round) is eight seconds; and the third time limit (after which cleaning the plate cylinder commences) is ten seconds.

Figure 5:
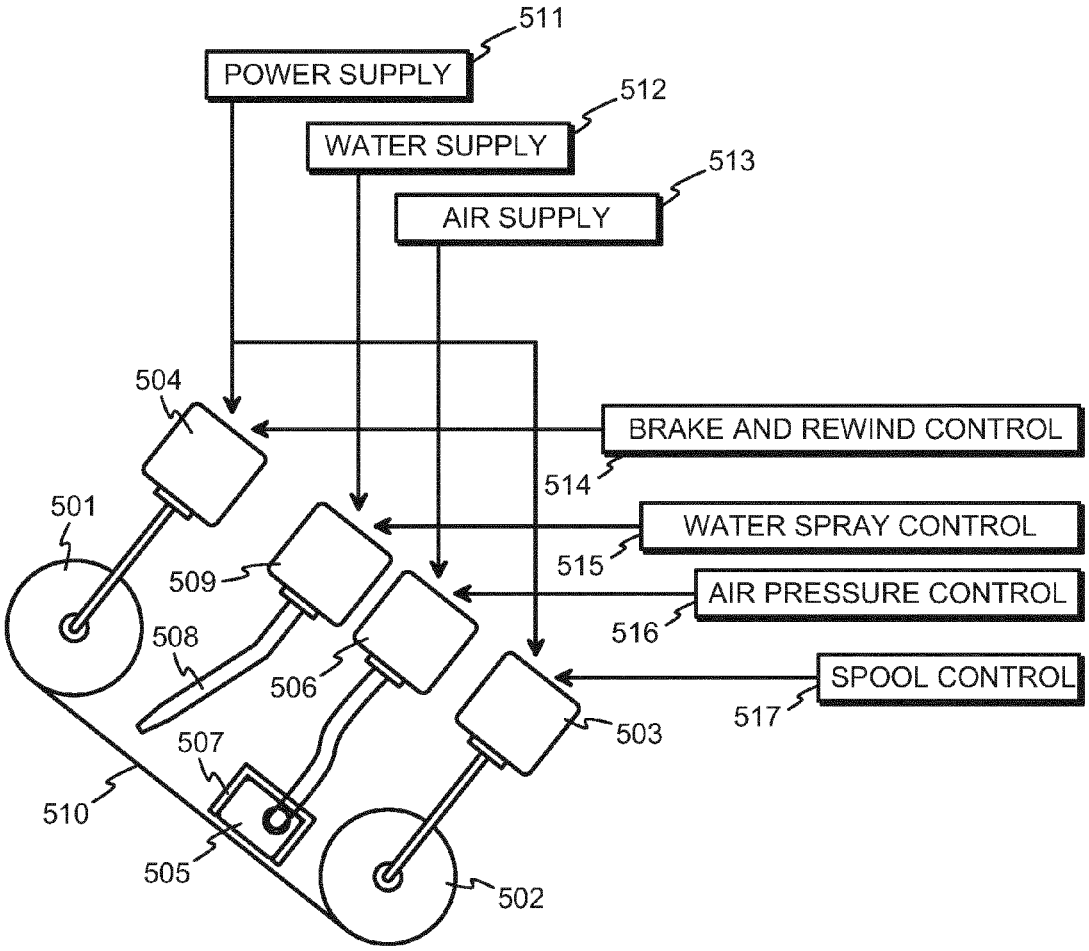
FIG. 5 illustrates an example of a cleaning arrangement.

Cleaning the outer surface of the plate cylinder at state 304 should effectively remove remnants of coating substance that would otherwise dry up on the plate cylinder. The dosing of new coating substance on the surface of the plate cylinder should be discontinued for the duration of cleaning. FIG. 5 illustrates an example of a cleaning arrangement that can be used for cleaning. The cleaning arrangement of FIG. 5 comprises a roll-to-roll type cleaning web, and wetting means for controllably wetting portions of the cleaning web.

A tangential moving mechanism is configured to controllably move the cleaning web in at least one direction in a plane defined by said cleaning web. The moving mechanism comprises a feed roller 501, a spool 502 parallel to said feed roller, and a motor 503 configured to rotate at least the spool 502 for winding cleaning web unwound from the feed roller 501 onto the spool 502. In the embodiment of FIG. 5, another motor 504 is provided for affecting the rotating movement of the feed roller 501.

A radial moving mechanism is configured to controllably move the cleaning web in at least one direction out of the cleaning web plane. In FIG. 5, the radial moving mechanism comprises an inflatable cushion 505 on the back surface side of the cleaning web, and a controllable valve 506 for inflating and deflating the inflatable cushion 505. In this embodiment, the inflatable cushion is shown installed within a housing 507 in order to ensure that inflating the inflatable cushion causes it to bulge primarily in the direction in which it presses the cleaning web against the plate cylinder.

For implementing the wetting, the cleaning arrangement of FIG. 5 comprises one or more wetting nozzles 508, with an operating direction towards the cleaning web. The operating direction is the primary direction into which wetting liquid is ejected from a wetting nozzle. Since the cleaning web has a certain width in its transverse direction (the direction directly into the paper in FIG. 5), and since it is advantageous to wet the whole width of the cleaning cloth, it may be advantageous to use a nozzle with a significant dimension in the transverse direction, and/or a number of nozzles 508 located next to each other in the transverse direction.

In order to control the amount, rate, and timing of the application of wetting liquid to the cleaning web, the cleaning arrangement of FIG. 5 comprises a wetting liquid dosing arrangement 509 that is configured to controllably deliver wetting liquid through the one or more wetting nozzles 508 towards the cleaning web. The wetting liquid dosing arrangement 509 may comprise, for example, a connection to a supply of pressurized water or other wetting liquid, as well as one or more controllable valves configured to control the flow of the wetting liquid from the supply to the nozzle(s).

If a wetting arrangement is used, it is advantageous to place it so that wetting of a portion of the cleaning web takes place either simultaneously or before that portion comes in contact with the outer surface of the plate cylinder. In the embodiment of FIG. 5, the one or more wetting nozzles 508 are located between the feed roller 501 and the spool 502, with the operating direction towards a planar portion 510 of the cleaning web drawn between the feed roller 501 and the spool 502. In the direction of movement of the cleaning web from the feed roller 501 towards the spool 502, the one or more wetting nozzles 508 are located before the radial moving mechanism, i.e., before the inflatable cushion 505.

Supply functions, i.e., the supply of driving (and braking) power 511, the supply of water or other wetting liquid 512, and the supply of air (or other inflating substance) 513 are shown schematically at the upper part of FIG. 5. Control functions, i.e., the control for braking and rewinding 514, the control for dosing water or other wetting liquid 515, the control for dosing air or other inflating substance 516, and the control for spooling the cleaning web 517 are shown schematically in the rightmost part of FIG. 5. The supply and control functions can be implemented in practice with means that are known as such from the technology of controlling printing processes.

Figure 6:
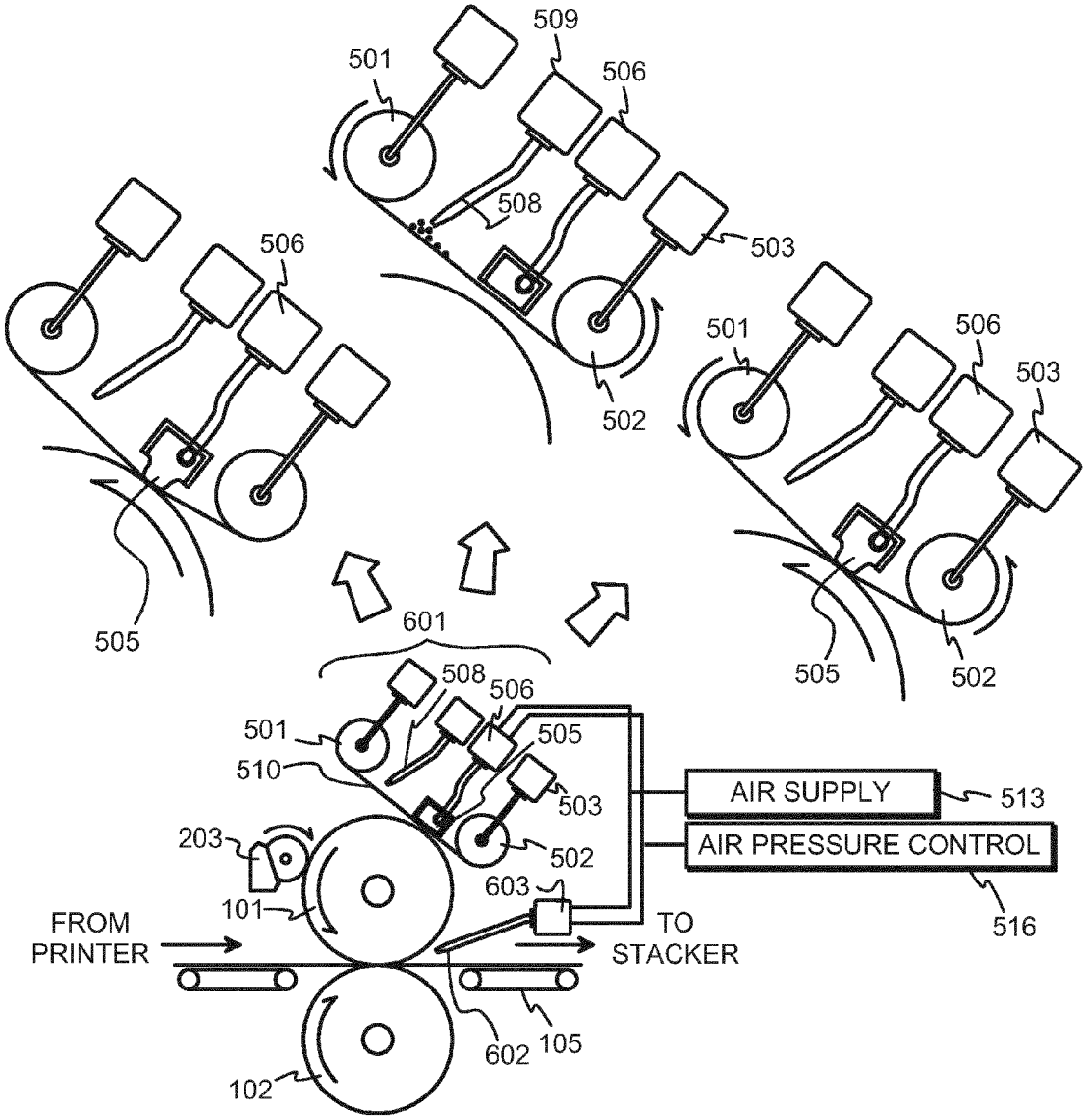
FIG. 6 illustrates a coater and exemplary methods of operation.

The top part of FIG. 6 illustrates examples of how the cleaning of the plate cylinder may be performed. The top left part illustrates using a radial moving mechanism—here comprising the inflatable cushion 505 and the controllable valve 506—to press a cleaning web against the outer surface of the plate cylinder, and rotating the plate cylinder to rub its outer surface against said cleaning web. The top middle part illustrates using a tangential moving mechanism—here comprising the feed roller 501 and the spool 502—to move the cleaning web in a direction tangential to the outer surface of the plate cylinder, in order to bring an unused portion of said cleaning web to a location where it can be pressed against the outer surface of the plate cylinder. It also illustrates wetting a portion of the cleaning web before pressing it against the outer surface of the plate cylinder. Wetting could be performed also simultaneously with pressing the cleaning web against the outer surface of the plate cylinder.

After pressing a wetted portion of the cleaning web against the outer surface of the plate cylinder, it is advantageous to wipe dry the plate cylinder by pressing a dry portion of the cleaning web against the outer surface of the plate cylinder. The top right part of FIG. 6 illustrates the possibility of spooling the cleaning web simultaneously with pressing it against the outer surface of a rotating plate cylinder.

In the lower part of FIG. 6, an additional drying mechanism is schematically illustrated. Remnant wetting liquid can be removed from the outer surface of the plate cylinder by blowing air towards the outer surface of the plate cylinder from a blower nozzle 602, with an operating direction directed towards the outer surface of the plate cylinder 101 and with a controllable valve 603 for controlling the air flow. The blower nozzle 602 may be one that is also used to ensure the detaching of a front end of a passing workpiece from the outer surface of the plate cylinder 101. A coating substance dosing entity 203 is schematically shown in FIG. 6 comprising only a single auxiliary roller.

Figure 7:
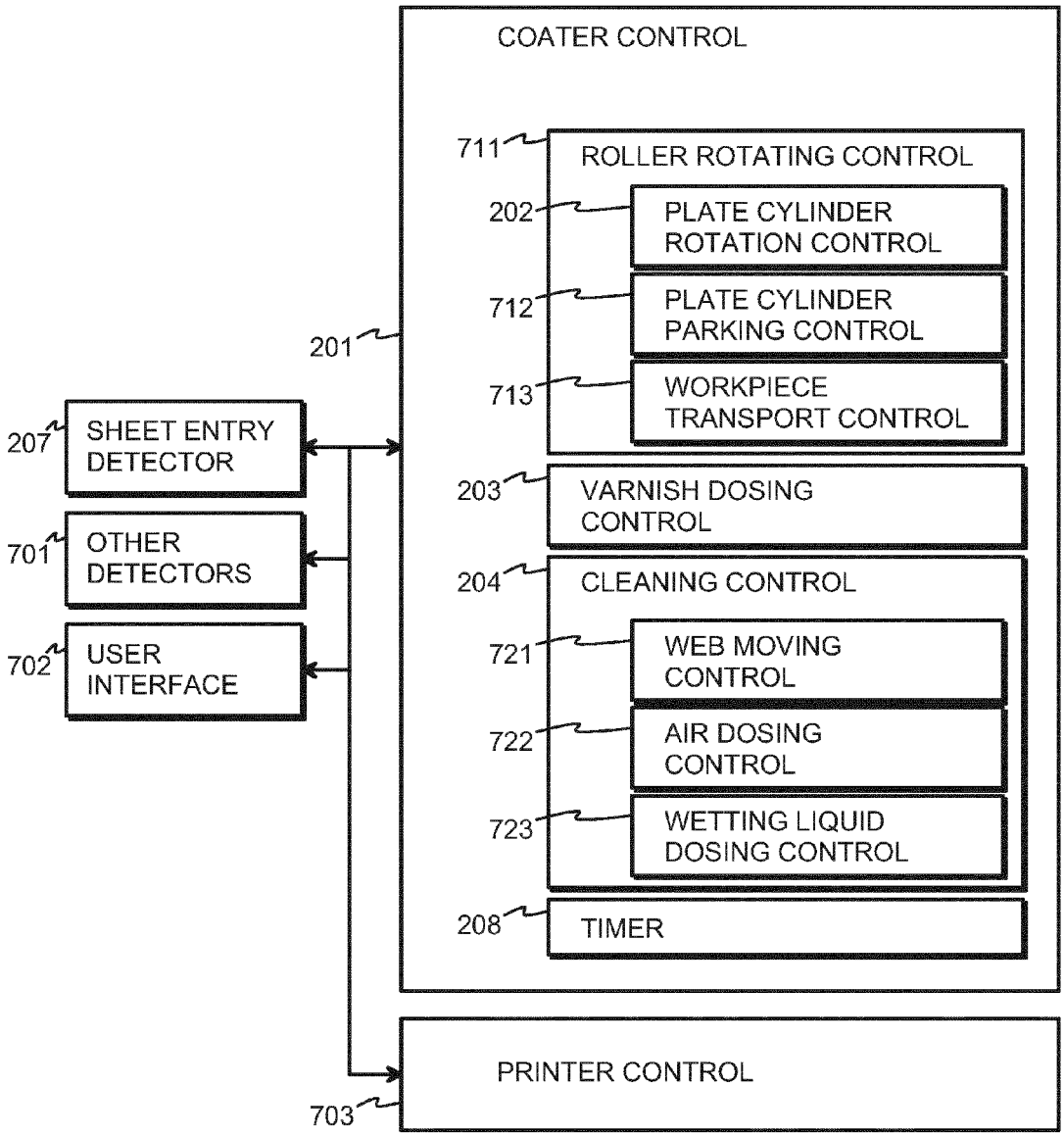
FIG. 7 illustrates aspects of controlling a coater.

A method for cleaning a coating unit according to an embodiment of the invention is preferably implemented by making a programmable control arrangement execute a program comprising computer-readable instructions that, when executed by a computer, cause the implementation of the method. FIG. 7 illustrates some exemplary aspects of compiling such computer-readable instructions in the form of a control program that involves interaction with other executable programs and with hardware parts. FIG. 7 can also be considered as a schematic illustration of a coater controller 201, which as a programmable entity is the part, through the operations of which the coater can be configured to perform various tasks.

The coater controller is schematically illustrated as 201. It may receive inputs from a sensor 207 that detects an incoming sheet-like workpiece when it is entering or about to enter the coater, as well as other sensors and detectors schematically illustrated as 701. Also schematically illustrated is a user interface 702, through which a user may give commands that affect controlling the coater, and through which indications, prompts, and responses may be conveyed to a user. The coater controller also advantageously interacts with the control functions governing the operation of other parts of the same manufacturing line, of which the printer control 703 is shown as an example in FIG. 7.

As a part of controlling the coater, controlling the various rollers and cylinders of the coating unit is illustrated as block 711. Plate cylinder rotation control 202 is the part through which the coater controller is configured to control the rotation of the plate cylinder, especially accelerating the plate cylinder to full coating speed for coating, maintaining the rotation rate of the cylinder at an appropriate value, and stopping the rotation of the plate cylinder as a response to a first time limit expiring after transferring a coated workpiece further without a subsequent workpiece entering the coating unit. As was described earlier, the coater controller may be configured to commence the rotation of the plate cylinder directly for coating a subsequent workpiece if the subsequent workpiece enters the coating unit before a second time limit expires after transferring said workpiece further, and to rotate the plate cylinder through a refreshing round of dosing coating substance before commencing the coating of a subsequent workpiece if the subsequent workpiece enters the coating unit after said second time limit expired but before a third time limit expires.

Shown separately is block 712, through which the coater controller is configured to park the plate cylinder to an appropriate position to wait for the next acceleration to begin. Also shown separately is block 713, through which the coater controller is configured to transport the uncoated workpieces towards the nip where they will receive the coating substance from the plate cylinder, and coated workpieces further on the manufacturing line.

Controlling the dosing of the varnish or other coating substance is illustrated schematically as block 203. For example, the coater should be configured to interrupt the dosing of coating substance when the cleaning of the plate cylinder commences.

Controlling the cleaning arrangement is illustrated schematically as block 204. It comprises controlling the movements of the cleaning web, as illustrated in 721. Moving the cleaning web involves using a radial moving mechanism to press a cleaning web against an outer surface of the plate cylinder, and using a tangential moving mechanism in a direction tangential to said outer surface of the plate cylinder to bring an unused portion of said cleaning web to a location where it can be pressed against the outer surface of the plate cylinder. This part of the cleaning control should interact with the control of the rotating movements of the rollers and cylinders in 711, for rotating the plate cylinder to rub its outer surface against the cleaning web.

Air dosing control, illustrated as 722, can be used to controllably inflate and deflate an inflatable cushion, the inflating of which causes it to bulge outwards and consequently push the cleaning web against the plate cylinder. Also, the task of temporarily detaching the cleaning web from the outer surface of the plate cylinder goes under air dosing control, if an inflatable cushion is used, because said detaching is accomplished by deflating the inflatable cushion. If the cleaning arrangement comprises one or more blower nozzles, air dosing control 722 can additionally be used for removing remnant wetting liquid from the outer surface of the plate cylinder by blowing air towards the outer surface of the plate cylinder from said blower nozzle(s). In an advantageous case said nozzle(s) is (are) also used to ensure the detaching of a front end of a passing workpiece from the outer surface of the plate cylinder.

Wetting liquid dosing control, illustrated as 723, can be used to wet a portion of the cleaning web before—or simultaneously with—pressing it against the outer surface of the plate cylinder. Since also interrupting the wetting can be considered to go under wetting liquid dosing control 723, it has also a role in the method step where, after pressing a wetted portion of the cleaning web against the outer surface of the plate cylinder, a dry portion of the cleaning web (which is dry because the delivery of wetting liquid was interrupted) is pressed against the outer surface of the plate cylinder.

The detailed embodiments that have been described above are not to be construed as limiting the scope of the present invention, since variations are possible in accordance with the concept of the present invention. As an example, the concept of a refreshing round (in singular) covers equally the possibility of rotating the plate cylinder through two or more refreshing rounds.

What is claimed is:

1. A method for operating a coating unit located after a sheet-fed digital printer on a manufacturing line, comprising the steps of:

a) as a response to a workpiece entering the coating unit from the printer, dosing a coating substance onto a plate cylinder, rotating said plate cylinder to transfer said coating substance onto said workpiece, and transferring said workpiece further on said manufacturing line, and b) as a response to expiration of a first time limit measured from the time that said work-piece has been transferred completely out of the coating unit without a subsequent workpiece entering the coating unit, stopping the rotation of the plate cylinder.

2. A method according to claim 1, wherein:

if the subsequent workpiece enters the coating unit before a second time limit expires after transferring said workpiece further, repeating the method of claim 1 directly from step a), and if the subsequent workpiece enters the coating unit after said second time limit expired but before a third time limit expires, rotating the plate cylinder through a refreshing round of dosing coating substance before repeating the method of claim 1 from step a).

3. A method according to claim 2, comprising:

as a response to said third time limit expiring without the subsequent work-piece entering the coating unit, cleaning an outer surface of the plate cylinder and parking the plate cylinder in a waiting position.

4. A method according to claim 3, wherein said cleaning is performed by:

using a radial moving mechanism to press a cleaning web against the outer surface of said plate cylinder, rotating the plate cylinder to rub its outer surface against said cleaning web, and using a tangential moving mechanism to move the cleaning web in a direction tangential to said outer surface of the plate cylinder to bring an unused portion of said cleaning web to a location where it can be pressed against the outer surface of the plate cylinder.

5. A method according to claim 4, comprising:

wetting a portion of said cleaning web before—or simultaneously with—pressing it against the outer surface of the plate cylinder.

6. A method according to claim 5, comprising:

after pressing a wetted portion of the cleaning web against the outer surface of the plate cylinder, pressing a dry portion of the cleaning web against the outer surface of the plate cylinder.

7. A method according to claim 5, comprising:

removing remnant wetting liquid from the outer surface of the plate cylinder by blowing air towards the outer surface of the plate cylinder from a blower nozzle that is also used to ensure the detaching of a front end of a passing workpiece from the outer surface of the plate cylinder.

8. A method according to claim 2, wherein:

a printing speed of said sheet-fed digital printer is between 1 and 1.25 meters per second, the ends included, said coating substance is water-based varnish, said first time limit is less than one second, said second time limit is eight seconds, and said third time limit is ten seconds.

9. A coater adapted for use after a sheet-fed digital printer on a manufacturing line, comprising:

a coating unit with a plate cylinder for transferring coating substance onto workpieces, a coater controller for controlling the rotation of said plate cylinder, wherein the coater comprises a timer coupled to said coater controller and configured to measure time that has passed since a workpiece was transferred completely out of the coating unit on said manufacturing line, and said coater controller is configured to stop the rotation of the plate cylinder as a response to expiration of a first time limit measured by said timer from transference of said workpiece completely out of the coating unit without a subsequent workpiece entering the coating unit.

10. A coater according to claim 9, wherein said coater controller is configured to:

commence the rotation of the plate cylinder directly for coating a subsequent workpiece if said subsequent workpiece enters the coating unit before a second time limit expires after transferring said workpiece further, and rotate the plate cylinder through a refreshing round of dosing coating substance before commencing the coating of a subsequent workpiece if the subsequent workpiece enters the coating unit after said second time limit expires, but before a third time limit expires.

11. A coater according to claim 10, wherein:

the coater comprises a plate cylinder cleaning unit, and said coater controller is configured to operate the cleaning unit for cleaning an outer surface of the plate cylinder as a response to said third time limit expiring without the subsequent workpiece entering the coating unit.

12. A coater according to claim 11, wherein the cleaning unit comprises:

a cleaning web, a tangential moving mechanism configured to controllably move said cleaning web in at least one direction in a plane defined by said cleaning web, a radial moving mechanism configured to controllably move said cleaning web in at least one direction out of said plane, and a controller coupled to said tangential and radial moving mechanisms, said controller being configured to control the moving of said cleaning web in conformity with input signals received by said controller.

13. A coater according to claim 12, wherein the cleaning unit comprises:

one or more wetting nozzles with an operating direction towards said cleaning web, and a wetting liquid dosing arrangement configured to controllably deliver wetting liquid through said one or more wetting nozzles towards said cleaning web.

14. A coater according to claim 13, wherein:

the tangential moving mechanism comprises a feed roller, a spool parallel to said feed roller, and a motor configured to rotate at least said spool for winding cleaning web unwound from said feed roller onto said spool, and the one or more wetting nozzles are located between said feed roller and spool, with said operating direction towards a planar portion of said cleaning web drawn between said feed roller and said spool.

15. A coater according to claim 9, comprising:

one or more blower nozzles with an operating direction directed towards the outer surface of the plate cylinder.

* * * * *